US007659232B1

(12) United States Patent
Thomas

(10) Patent No.: US 7,659,232 B1
(45) Date of Patent: Feb. 9, 2010

(54) GARDEN TOOL MAINTENANCE FLUID

(75) Inventor: Bruce Thomas, Carlsbad, CA (US)

(73) Assignee: Novel Wares, Inc., Carlsbad, CA (US)

( * ) Notice: Subject to any disclaimer, the term of this patent is extended or adjusted under 35 U.S.C. 154(b) by 673 days.

(21) Appl. No.: 11/199,605

(22) Filed: Aug. 8, 2005

(51) Int. Cl.
*C10M 169/04* (2006.01)
*C10M 159/08* (2006.01)
*C10M 129/26* (2006.01)

(52) U.S. Cl. ..... 508/491; 508/110; 508/459

(58) Field of Classification Search ..... 508/110, 508/491, 459
See application file for complete search history.

(56) References Cited

U.S. PATENT DOCUMENTS

| | | | | |
|---|---|---|---|---|
| 7,037,955 | B2 * | 5/2006 | Timcik et al. | 523/102 |
| 2004/0223998 | A1 * | 11/2004 | Iyer et al. | 424/405 |
| 2005/0233930 | A1 * | 10/2005 | Cheung et al. | 510/407 |

* cited by examiner

*Primary Examiner*—Glenn Caldarola
*Assistant Examiner*—Jim Goloboy

(57) ABSTRACT

A fluid safe to plants and the environment for maintenance facilitation of hand or power garden shear and saw tools. When the said fluid with a pleasant odor is sprayed onto the blades of said tools it will clean, lubricate, disinfect and inhibit rust in one step on said tools while repelling some types of flying insect pests.

1 Claim, No Drawings

GARDEN TOOL MAINTENANCE FLUID

BACKGROUND OF THE INVENTION

1. Field of Invention

This invention relates to the safe maintenance of tools, specifically hand or power garden shears and saws, while repelling some types of flying insect pests.

2. Prior Art

Hand or power garden shear and saw tools require maintenance in order to work properly and disinfection of said tools is required in order to prevent plant cross contamination from infected tools. Existing methods for tool maintenance include cleaners, lubricants, disinfectants and corrosion/rust inhibitors, which can be corrosive, flammable and/or have an unpleasant odor. Prior art usually involves several time consuming maintenance steps in order to clean, lubricate, disinfect and inhibit rust on said tools. This invention, safe to plants and the environment, reduces four maintenance steps to one step and provides a pleasant odor, which will repel some types of flying insect pests. Dirt build-up on said tools is generally water soluble and must be removed for good tool cutting service. Prior art is usually an oil soluble petroleum distillate, which won't loosen water soluble dirt unless abrasion is implemented during the cleaning process. Said abrasion can damage tool cutting edges if care effort isn't used. Some water soluble prior art will promote rust on tools with carbon steel blades.

SUMMARY

When this invention is applied as a fluid spray to dirty and infected hand or power garden tool shear and saw blades it will safely clean, lubricate, disinfect and inhibit rust on the said blades in one step. While providing a pleasant odor that repels some types of flying insect pests.

DETAILED DESCRIPTION

A composition consisting of the following five chemical compounds mixed at room temperature, which are listed by their weight in the formula for this invention:

| | |
|---|---|
| 1. Deionized Water 93% to 95% | 2. Cottonseed Oil 4% to 6% |
| 3. Lemongrass Oil 0.5% to 1.5% | 4. Potassium Sorbate 0.2% to 0.4% |
| 5. Polyoxyethylene 2,6,8-trimethyl-4-nonyl ether 0.1% to 0.2% | |

1. Deionized water in the formula produces the principal low viscosity aqueous matter of the invention. Low viscosity produces the easy spray mist application of the invention to garden tools. Deionized water reduces residue on cleaned surfaces. Further, water will loosen the dirt on garden tools without using abrasion, such as the use of steel wool, which can damage tool cutting edges.

2. Cottonseed oil is an inexpensive food grade lubricant with good lubricity. The low viscosity of cottonseed oil allows it to flow freely through a mist pump sprayer for the application of the invention to garden tools. Garden tools operate better when they are lubricated. Cottonseed oil kills fungus plant pathogens with desiccation. Said pathogens on infected plants can come in contact with garden tools when plants are cut and plant pathogens can spread to healthy plants on tools if the pathogen isn't mitigated or killed.
3. Lemongrass oil has a pleasant odor and will repel some types of flying insect pests such as mosquitoes and flies, which are both considered to be a nuisance in the garden. Lemongrass oil is an active ingredient in the formula of the invention and contains citral, which is an aldehyde that will kill the most common bacteria plant pathogen (Erwinia amylovora) that can cross contaminate plants with the use of garden tools. Lemongrass oil is recognized by the United States Environmental Protection Agency as a minimum risk pesticide.
4. Potassium sorbate is an active ingredient in the formula of the invention that will inhibit the growth of fungus plant pathogens that can cross contaminate plants with the use of garden tools. Potassium sorbate is recognized by the United States Environmental Protection Agency as a minimum risk pesticide. Potassium sorbate combined with water will inhibit rust corrosion on carbon steel (ferrous metal) garden tool blades that come in contact with the said water.
5. Polyoxyethylene 2,6,8-trimethyl-4-nonyl ether is a food grade non-ionic surfactant and emulsifier. Said ether reduces the surface tension of the water ingredient in the formula of the invention, which creates good detergency. Said ether creates an emulsion with the water and oil ingredients of this invention so they will remain emulsified long enough to apply the invention to garden tools.

After this invention has been applied to garden tools as an aqueous spray, dirt is easily removed from said tools with a cloth or soft bristle brush while the pleasant odor of the invention repels some types of flying insect pests. The invention inhibits rust on the said tools and a film of lubricating oil remains on the said tools after the dirt is removed to allow smooth operation of the tools. If bacteria and/or fungus plant pathogens land on the said tools the pathogens will be mitigated and/or killed by the invention before they can cross contaminate healthy plants.

I claim:

1. A lemon scented fluid comprising, in percents by weight, 93-95% deionized water, 4-6% cottonseed oil, 0.5-1.5% lemongrass oil, 0.2-0.4% potassium sorbate and 0.1-0.3% of a food grade surfactant, safe to the environment, whereby when sprayed onto dirty and infected hand or power garden saw and shear tool blades will provide cleaning, lubrication, disinfection and rust inhibition of said tool blades in one step while also repelling some types of flying insect pests.

* * * * *

UNITED STATES PATENT AND TRADEMARK OFFICE

CERTIFICATE OF CORRECTION

PATENT NO. : 7,659,232 B1
APPLICATION NO. : 11/199605
DATED : February 9, 2010
INVENTOR(S) : Bruce Thomas It is certified that error appears in the above-identified patent and that said Letters Patent is hereby corrected as shown below:

Page 2, column 1, line 46 Deionized Water "93%" to 95% should be changed to Deionized Water --92%-- to 95%;

Page 2, column 2, lines 30 thru 36 reading 5. "Polyoxyethylene 2,6,8-trimethyl-4-nonyl ether" is a food grade "non-ionic" surfactant and emulsifier. Said "ether" reduces the surface tension of the water ingredient in the formula of the invention, which creates good detergency. Said "ether" creates an emulsion with the water and oil ingredients of this invention so they will remain emulsified long enough to apply the invention to garden tools.", should be corrected to read
5. --1,2,3- Propanetriol, homopolymer (9Z)-9-octadecenoate-- is a food grade --polyglycerol ester-- surfactant and emulsifier. Said --ester-- reduces the surface tension of the water ingredient in the formula of the invention, which creates good detergency. Said --ester-- creates an emulsion with the water and oil ingredients of this invention so they will remain emulsified long enough to apply the invention to garden tools.--;

Page 2, column 2, line 49 Claim 1 of the Patent Certificate reading "93"-95% deionized water should be changed to --92--.

Signed and Sealed this

Twenty-first Day of December, 2010

David J. Kappos

David J. Kappos
*Director of the United States Patent and Trademark Office*